United States Patent [19]

Jones

[11] Patent Number: 4,604,056

[45] Date of Patent: Aug. 5, 1986

[54] VACUUM FURNACE SYSTEM HEARTH

[76] Inventor: William R. Jones, 3 Hillcraft Way, Telford, Pa. 18964

[21] Appl. No.: 707,217

[22] Filed: Mar. 1, 1985

[51] Int. Cl.[4] ..... F23D 23/00; F27B 9/14

[52] U.S. Cl. ..... 432/249; 432/234; 432/235

[58] Field of Search ..... 432/233, 234, 235, 153, 432/123, 125, 249

[56] References Cited

U.S. PATENT DOCUMENTS

| | | | |
|---|---|---|---|
| 1,341,928 | 6/1920 | Rennie | 432/235 |
| 3,015,478 | 1/1962 | Buckholdt et al. | 432/235 |
| 3,168,297 | 2/1965 | Brough | 432/234 |
| 3,214,152 | 10/1965 | Molz | 432/235 |
| 3,421,747 | 1/1969 | Seelandt et al. | 432/249 |
| 3,464,681 | 9/1969 | Olivotto | 432/235 |
| 4,102,637 | 7/1978 | Krieder et al. | 432/235 |
| 4,144,022 | 3/1979 | Fusco | 432/249 |
| 4,212,633 | 7/1980 | Krieder et al. | 432/234 |
| 4,391,587 | 7/1983 | Murakami et al. | 432/235 |

*Primary Examiner*—Henry C. Yuen

*Attorney, Agent, or Firm*—William E. Cleaver

[57] ABSTRACT

The present hearth is composed of a plurality of support bars, which are made of graphite in the preferred embodiment, and which are arranged to be parallel to the length of the hot zone chamber and orthogonal to the mouth of the vacuum furnace. Each of the support bars has a groove, or a channel, formed in its upper surface and disposed in each of said channels is one or more rotatable molybdenum load support rods each of which has been impregnated, or coated, with titanium nitride. To the underside of each support bar there are secured molybdenum bar support rods which are located and secured to hold the support bars away from coming in contact with the heating elements of the hot zone.

4 Claims, 2 Drawing Figures

VACUUM FURNACE SYSTEM HEARTH

BACKGROUND

Figure 1:
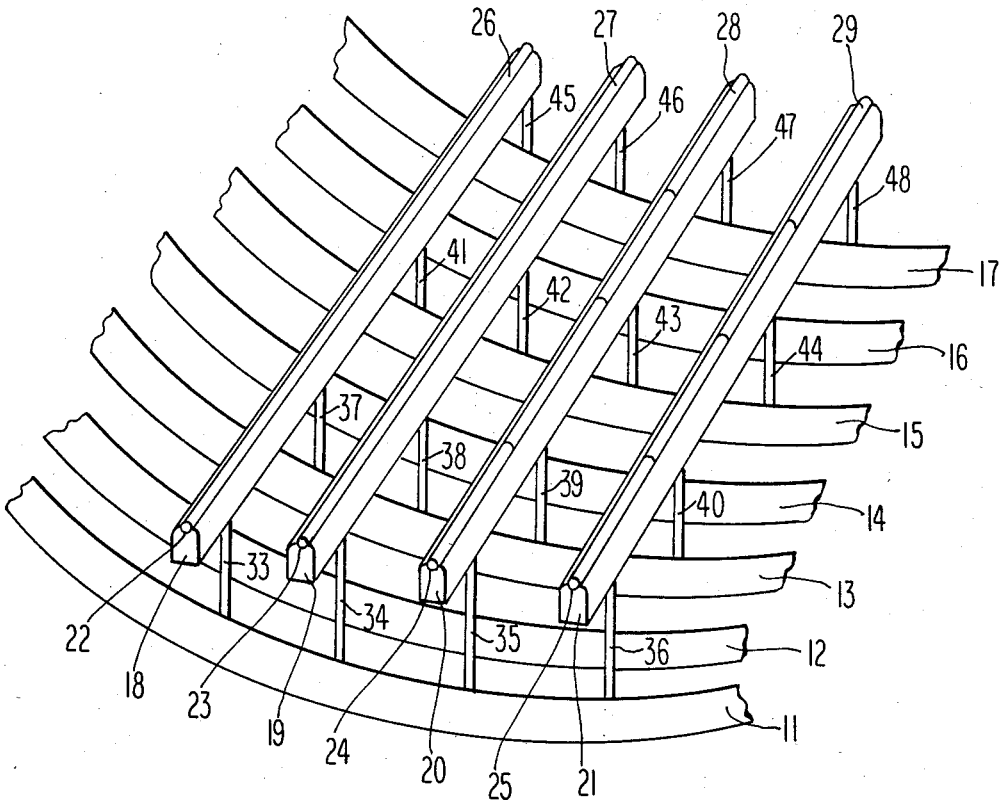

It is well understood in the vacuum furnace art that the materials to be heat treated must be supported away from the heating element per se and preferably in a position to have all of the material to be heat treated receive heat uniformally or very nearly uniformally. In the prior art the materials to be heat treated (the loads) have been held supported by stainless steel networks of bars or solid molybdenum bars. Such an arrangement had a number of undesirable aspects such as the work baskets which sat on the bars would fuse with the bars and would expand at a different rate than the bars, thereby causing the molybdenum bars or stainless steel networks to fracture. More recently the loads have been held on a hearth composed of support bars made of graphite. The support bars have been formed with a groove, or channel, on the upper surface and into each channel there has been located a plurality of ceramic, or non-metallic, rollers. Such support bars have been located so as to be parallel to the width of the mouth of a vacuum furnace or orthogonal to the length of the hot chamber. In the foregoing configuration the load can be rolled into the hot zone. However in such a prior art arrangement, the ceramic, or non-metallic, rollers are subject to thermal shock and are readily broken under the weight of a load. To accommodate the regular breakage, the roller is divided into small segments, that is a channel of 48 inches would have 12, four inch rollers located therein. This type of hearth is described in detail in U.S. Pat. No. 3,421,747. The prior art arrangements did not turn to using metallic rollers because of the propensity of the graphite bars and metallic rollers to fuse under high temperatures. The prior art also did not turn to metallic rollers because of the eutectic effect between such metallic rollers and the baskets that carry the materials to be heat treated.

The present arrangement includes metallic rollers which neither "stick" to the graphite bars and which do not fuse with the baskets that carry the materials.

SUMMARY

The hearth described and claimed herein is made up of support bars fabricated, in a preferred embodiment, from graphite. The support bars are located in the hot zone so that they run parallel with the length of the hot zone and are mounted on molybdenum support rods. The molybdenum support rods hold the support bars away from the heating elements. Along the longitudinal upper side of each of the support bars there is formed a groove, or channel, into which there is loaded a molybdenum rod which has been impregnated, or coated, with titanium nitride. The titanium nitride prevents, or mitigates, any affinity that molybdenum may have for graphite or other metals so that the molybdenum rods are freely rotatable in the channels and do not fuse with the load, or baskets holding the load, when the materials to be heated are subjected to high temperatures. By having the loads move parallel to the axis of the rollers, rather than rolling the loads into the hot zone, I have found less damage to the rollers. The foregoing plus use of molybdenum, impregnated with titanium nitride (the molybdenum being virtually non susceptible to thermal shock), has dramatically improved the wear of such a hearth when compared with prior art hearths.

Figure 2:
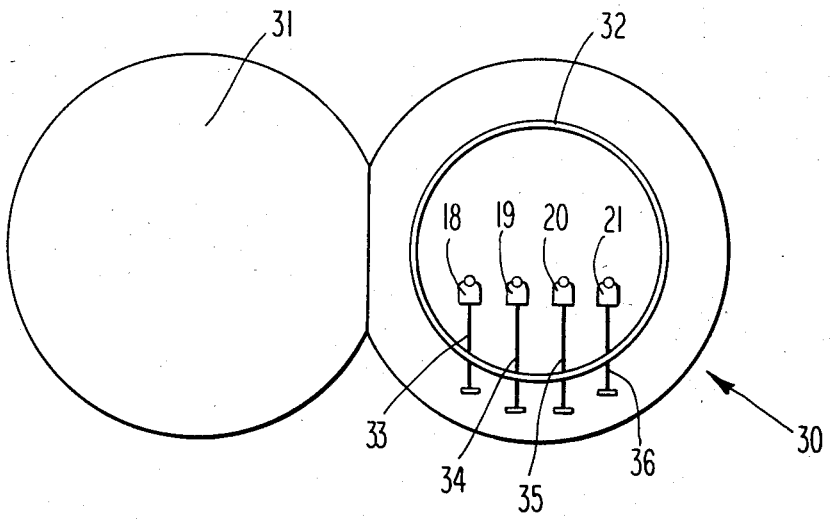

The objects and features of the present invention will be better understood in view of the following description taken in conjunction with the drawings wherein:

FIG. 1 is a pictorial schematic depicting four support bars located in a section of the hot zone; and FIG. 2 is a schematic view looking into an open end of a vacuum furnace.

Consider FIG. 1. In FIG. 1 there is shown a plurality of heating elements 11 through 17. It should be understood that the heating elements are shown in part only and actually are formed to complete a circle. The heating elements are made of molybdenum and are connected to an electrical power source. When electricity is passed through the heating elements they generate heat.

Further in FIG. 1 there are shown four support bars 18, 19, 20 and 21. The support bars are fabricated from graphite in a preferred embodiment, although other materials may be used. Graphite is used in the preferred embodiment because graphite has great tensile strength at high temperatures and a low coefficient of thermal expansion. Graphite shows very little tendency to be distorted under heavy loads at even high temperatures. While other metals such as tungsten or molybdenum have similar good qualities, graphite costs considerably less and is therefore more economical.

As can be gleaned from FIG. 1, the upper surface of each of the support bars 18 through 21 is milled to provide a groove or channel therein. In the support bar 18, as can be seen, there is a channel 22; in support 19, there is a channel 23; in support bar 20, there is a channel 24; and in support bar 21, there is a channel 25. The channels 22 through 25 run longitudinally for the length of the support bar. Into each milled channel there is located a molybdenum rod. Each of the molybdenum rods 26 through 29 is impregnated, or coated, with titanium nitride. The presence of titanium nitride reduces the fusion phenomenon between the molybdenum roller rod and the graphite support bar. Accordingly there is no sticking or gauling between the graphite support bar and its associated molybdenum roller rod.

As can be seen in FIG. 1, the molybdenum rod 26 is shown as a single rod while the rods 28 and 29 are shown as segmented rods. In the preferred embodiment the roller rods are segmented because since there are gaps between the segments of the rod, the detrimental effect of thermal expansion is reduced and accumulated mechanical stress is prevented.

In addition to reducing, or even eliminating, the gauling or sticking between the roller rods and the graphite, the molybdenum roller rods coated with titanium nitride reduce, or even eliminate, the eutectic effect between the roller rods and the work pieces or the baskets which hold the work pieces. The fact that the roller rods are made from a metal (molybdenum) which has a low coefficient of expansion and which suffers very little from thermal shock, enables such roller rods to withstand far greater loading abuse than ceramic roller rods.

In addition to the superior strength of the metal roller rods as compared to the ceramic roller rods, I have found that if the support bars are located to run parallel to the axis of the hot zone and orthogonal to the opening of the vacuum furnace then the roller rods provide greater wear. When the support rods are located as shown in FIG. 2 the load, when it is moved into the vacuum chamber, provides a some shear force against the length of the rod but the weight is distributed over the four roller rods. In prior art configurations, wherein the roller rods are located parallel to the opening of the furnace, the load is rolled into the hot zone and at some instant in time the entire weight is loaded onto a single rod. Accordingly in such prior art arrangements the ceramic roller rods continually break due to their response to thermal shock, the uneven distribution of weight during a loading operation, and the relative weakness of a ceramic material as compared to molybdenum.

In FIG. 2 there is shown a vacuum furnace 30, which has a door 31, and a hot zone 32. Within the hot zone are located the support bars 18, 19, 20 and 21.

Note that in FIG. 1 and FIG. 2, the support bars are mounted on molybdenum bar support rods 33 through 48. The molybdenum bar support rods are formed to be long enough to hold the support bars away from the heating elements and long enough to hold the work piece relatively close to the center of the hot zone. Molybdenum is employed as the bar support rods because it is not subject to detrimental thermal shock and therefor does not break readily. Molybdenum has been found to be particularly useful, as compared with other materials, where it is secured to the base of the furnace molybdenum when so secured performs without fracturing.

If the molybdenum roller rods 26 through 29 are not coated with titanium nitride, then the graphite fuses with the molybdenum to some extent and the rollers tend to freeze in the groove in the graphite support bar. The rollers must be free to roll to accommodate the difference in the coefficients of thermal expansion between the bars and the load or baskets holding the load. As the load expands it in effect rolls over the rollers. Any subsequent attempts to roll a "frozen" roller rod very often causes damage to the roller rod. In the present device the rollers stay free and the thermal expanding load can roll within the hot zone but at such time the weight is shared by all of the roller rods. The molybdenum rolling rods are coated or impregnated with titanium nitride by a chemical vapor deposition method. Other materials such as nitride or oxide compounds could be used as an interface, but I have found titanium nitride operates very satisfactorily.

I claim:

1. A hearth arrangement to be used in a hot zone of a vacuum furnace, which vacuum furnace has an opening to pass work pieces therethrough and which hot zone has heat generating means therein, comprising in combination: a plurality of support bars formed of material which has good tensile strength at high temperatures and low thermal expansion, each of said support bars formed to have an upper surface and a lower surface and each having a depth dimension therebetween, each of said support bars further formed to have a longitudinal groove along its upper surface; a plurality of molybdenum bar support rods, with a different group thereof respectively secured to the lower surface of a different associated one of said support bars, said molybdenum bar support rods formed to hold its associated support bar free of coming in contact with said heating generating means; and a plurality of load support rods formed of molybdenum and coated with titanium nitride and each of said support rods formed to rotatably fit into said groove of an associated support bar.

2. A hearth arrangement according to claim 1 wherein said support bars are disposed to lie parallel to the length of said hot zone and substantially perpendicular to said opening in said vacuum furnace.

3. A hearth arrangement according to claim 1 wherein said support bars are fabricated from graphite.

4. A hearth arrangement according to claim 1 wherein each of said support rods is divided into a number of segments and said segments are formed to have a gap between adjacent ends of neighboring segments.

* * * * *